US005172946A

United States Patent [19]

Dowling

[11] Patent Number: 5,172,946

[45] Date of Patent: Dec. 22, 1992

[54] FRAME ASSEMBLY OF TRUNK LID LOCKING DEVICE

[75] Inventor: Patrick J. Dowling, Nirasaki, Japan

[73] Assignee: Mitsui Kinzoku Kogyo Kabushiki Kaisha, Tokyo, Japan

[21] Appl. No.: 857,156

[22] Filed: Mar. 25, 1992

[30] Foreign Application Priority Data

Mar. 26, 1991 [JP] Japan ..... 3-86209

[51] Int. Cl.[5] ..... E05C 3/26

[52] U.S. Cl. ..... 292/216; 292/337; 292/DIG. 43; 292/DIG. 64

[58] Field of Search ..... 292/337, 216, 280, DIG. 43, 292/DIG. 64

[56] References Cited

U.S. PATENT DOCUMENTS

| | | | |
|---|---|---|---|
| 2,324,264 | 7/1943 | Lustig | 292/DIG. 43 X |
| 2,709,909 | 6/1955 | Vigmostad | 292/DIG. 43 X |
| 2,917,916 | 12/1959 | Dall | 292/DIG. 43 X |
| 2,996,327 | 8/1961 | France et al. | 292/216 X |
| 3,170,722 | 2/1965 | Schutte | 292/DIG. 43 X |
| 3,504,511 | 4/1970 | Allen | 292/216 X |
| 3,809,416 | 5/1974 | Kozoaka | 292/216 |
| 5,074,603 | 12/1991 | Brackmann | 292/DIG. 43 X |

*Primary Examiner*—Richard E. Moore
*Attorney, Agent, or Firm*—Browdy and Neimark

[57] ABSTRACT

A frame assembly of a trunk lid locking device comprises a lower frame of vessel-shaped formed by bending four sides of a base plate about at a right angle, a latch placed in an interior of the lower frame and engaged with a striker to be rotated, a ratchet for preventing the latch from reversely rotating, an upper frame of approximately flat plate-like for closing an upper opening of the lower frame. An engagement hole extending in a left-and-right direction is formed on one of a front side of the upper frame and a top end of the lower frame, and a L-shaped engagement portion is formed on the other of the top end of the lower frame and the front side of the upper frame so as to engage with the engagement hole.

1 Claim, 2 Drawing Sheets

FRAME ASSEMBLY OF TRUNK LID LOCKING DEVICE

BACKGROUND OF THE INVENTION

The present invention relates to a frame assembly of a locking device used for an automobile trunk lid.

According to known locking devices for the automobile trunk lid, the conventional locking devices have a vessel-shaped lower frame formed by bending the four sides of a base plate approximately at a right angle, a striker attached to a trunk lid, a latch rotating and engaging with the striker, and a ratchet for preventing the latch from reverse-rotating. The latch and the ratchet are rotatably contained in the lower frame. An upper opening of the lower frame is closed by an upper frame of approximately flat shape. The lower frame and the upper frame are together secured or fastened to the automobile body by means of bolts and the like.

According to the conventional locking device above, the lower frame and the upper frame are together fastened to the automobile body under the condition in which the upper frame is merely placed on the upper opening of the lower frame, thereby the upper frame and the lower frame fails to have a construction having a mutual reinforcement.

SUMMARY OF THE INVENTION

Accordingly, it is the purpose of the present invention to provide a frame assembly of a trunk lid locking device, which assembly has an upper frame and a lower frame, respectively engageable to be mutually reinforced, therefore it is possible to raise the strength of the frame assembly when the thickness of the iron plate to be used to make the assembly is not raised.

EMBODIMENT

Figure 1:
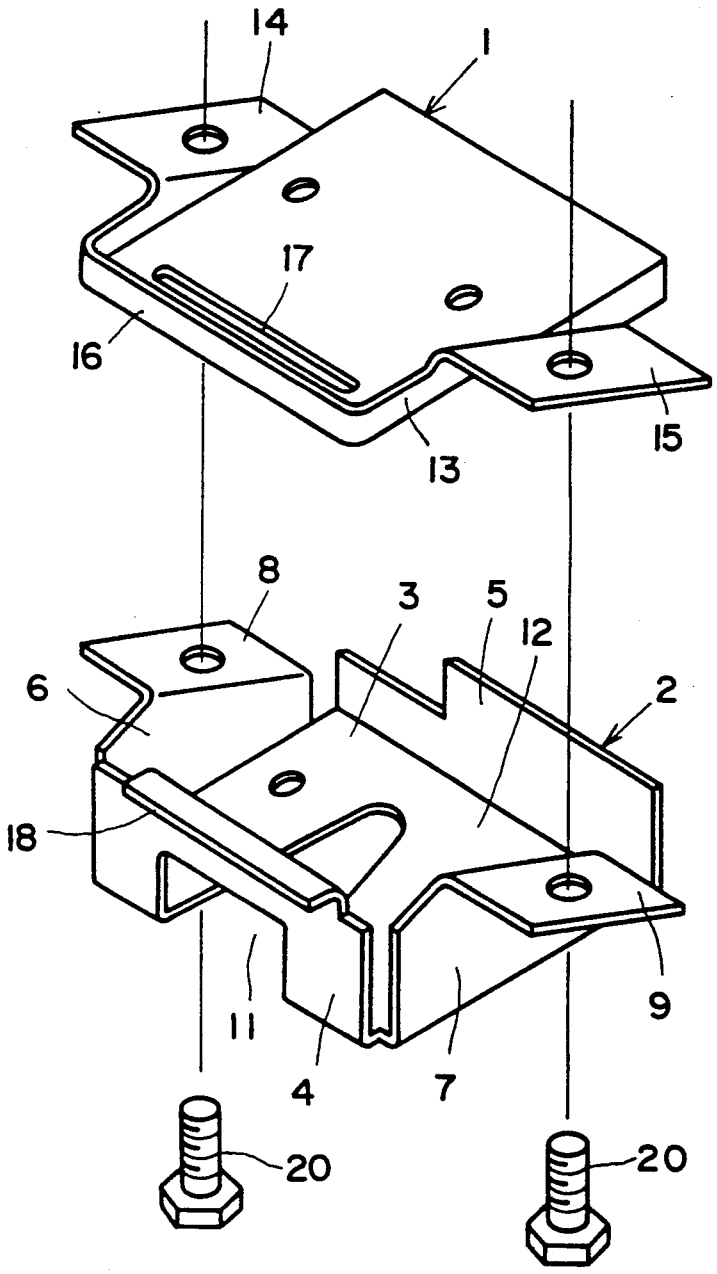
FIG. 1 is an exploded perspective view of the upper frame and the lower frame of the locking device.
Figure 2:
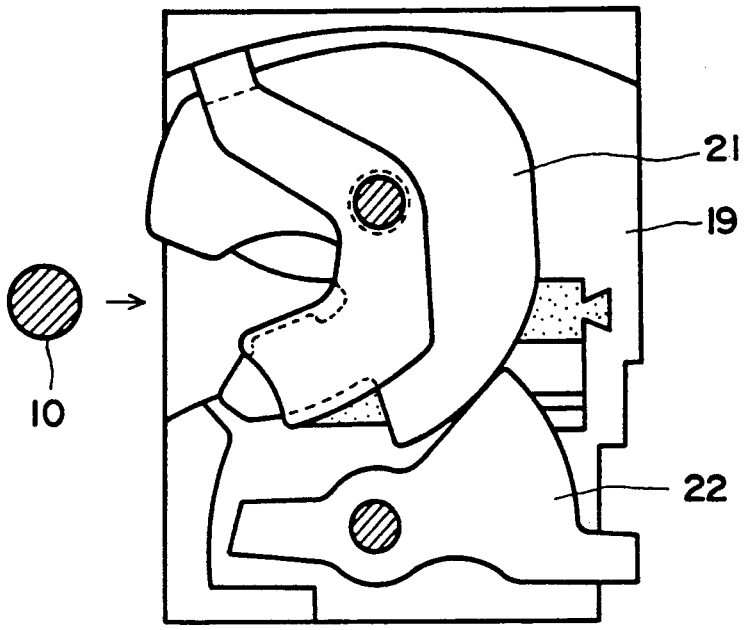
FIG. 2 is a section of the locking device.
Figure 3:
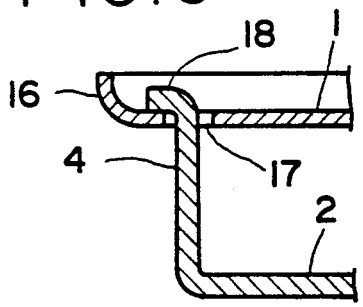
FIG. 3 is an enlarged section of an engagement portion of the upper frame and lower frame.

One embodiment of the frame assembly according to the present invention will be explained with reference to the accompanying drawings.

After the upper frame 1 and the lower frame 2 of the trunk lid locking device are mutually assembled, the assembly of the frames are secured to the automobile body by bolts 20. In an actual assembling work, the lower frame 2 is placed at an upper position and the upper frame 1 is at an lower position.

The lower frame 2 is made by bending upward on the four sides of an about-rectangular shape base plate 3 so as to make a front wall 4, a rear wall 5, a right wall 6, and a left wall 7 forming a whole shape of a vessel shape (box shape). It is apparent that the upper edges of the right wall 6 and the left wall 7 are bent sideward so as to make lower fixing faces 8 and 9. The base plate 3 and the front wall 4 are formed so as to have therein an insert or intering groove 11 through which a striker 10 secured to the trunk lid proceeds or enters.

The upper frame 1 has a flat plate shape enabling it to close the upper opening 12 of the lower frame 2. The upper frame 1 has a reinforcement flange 13 extending along four sides of the upper frame 1. The flange 13 has a pair of upper frame fixing faces 14 and 15, respectively applied to and overlapped with the lower frame fixing faces 8 and 9.

The construction above of the frame assembly is identical with that of the conventional frame assembly excepting that a front side 16 of the upper frame 1 has an engagement hole 17 extending left-and-right and a top end of the front wall 4 of the lower frame 2 has an engagement portion 18 of a L-shaped in section adapted to be engaged with the engagement hole 17.

A space enclosed with the upper frame 1 and the lower frame 2 contains a plastic-made body 19. The plastic-made body 19 contains the latch 21 adapted to engage with the striker 10, and the ratchet 22 for preventing the latch 21 from reverse turning so as to rotate.

Figure 4:
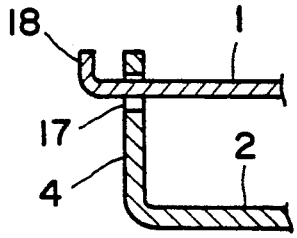
FIG. 4 is an enlarged section of a different engagement portion of the upper frame and lower frame.

It is possible to form, as shown in FIG. 4, an engagement hole 17 extending in a left-and-right direction at a top end of the front wall 4 of the lower frame 2, and the L-shaped engagement portion 18 adapted to engage with the engagement hole 17 at a front side 16 of the upper frame 1.

OPERATION

According to the construction of the frame assembly of the present invention, the upper frame 1 and the lower frame 2 are manufactured by a pressing process and other similar processes and the synthetic resin or plastics made body 19 provided with the latch 21 and the ratchet 22 respectively attached thereto is housed in the lower frame 2. Next, the upper frame fixing faces 14 and 15 are overlapped on the lower frame fixing faces 8 and 9, and the L-shaped engagement portion 18 of the front wall 4 is inserted into the engagement hole 17 of the upper frame 1 in order to close the upper opening 12 of the lower frame 2 with the upper frame 1 finishing an assembly of the locking device. The assembled locking device is fixed to the automobile body by inserting the bolts 20 through the overlapped lower frame fixing face 8 and the upper frame fixing face 14, and 9 and 15, respectively.

According to the present invention, when the locking device is fixed to the automobile body, the upper frame 1 and the lower frame 2 are engaged with each other to mutually reinforce, thereby it is possible to raise exceedingly a strength of the assembled locking device even though relative thin metal plate is used to manufacture these frames.

What is claimed is:

1. A frame assembly of a trunk lid locking device comprising:

a lower frame of a vessel shape formed by bending four sides of a base plate approximately at a right angle, and a top end of a front wall of said lower frame into an engagement portion of an L-shape a latch placed in an interior of said lower frame and engagement with a striker to rotate, and a ratchet for preventing said latch from reverse-rotating, an upper frame of approximately flat plate shaped for closing an upper opening of the lower frame, and wherein a hole extending in a left-and-right direction is formed on a front side of said upper frame, and said L-shape engagement portion formed on the top end of the front wall for assemblage of said locking device by engagement of said L-shape engagement portion into said hole extending in a front side of said upper frame.

* * * * *